United States Patent [19]

Nishimoto

[11] Patent Number: 4,644,839

[45] Date of Patent: Feb. 24, 1987

[54] METHOD OF SYNTHESIZING MUSICAL TONES

[75] Inventor: Tetsuo Nishimoto, Hamamatsu, Japan

[73] Assignee: Nippon Gakki Seizo Kabushiki Kaisha, Hamamatsu, Japan

[21] Appl. No.: 852,390

[22] Filed: Apr. 15, 1986

Related U.S. Application Data

[63] Continuation of Ser. No. 759,936, Jul. 29, 1985, abandoned, which is a continuation of Ser. No. 656,442, Oct. 2, 1984, abandoned, which is a continuation of Ser. No. 600,595, Apr. 16, 1984, abandoned, which is a continuation of Ser. No. 544,063, Oct. 23, 1983, abandoned, which is a continuation of Ser. No. 410,841, Aug. 23, 1982, abandoned, which is a continuation of Ser. No. 300,193, Sep. 8, 1981, abandoned, which is a continuation of Ser. No. 152,306, May 22, 1980, abandoned, which is a continuation of Ser. No. 66,285, Aug. 13, 1979, abandoned, which is a continuation of Ser. No. 842,325, Oct. 14, 1977, abandoned.

[30] Foreign Application Priority Data

Oct. 16, 1976 [JP] Japan ..... 51-123439

[51] Int. Cl.[4] ..... G10H 1/043; G10H 7/00

[52] U.S. Cl. ..... 84/1.01; 84/1.22; 84/1.24; 364/721; 364/851

[58] Field of Search ..... 84/1.01, 1.03, 1.11–1.13, 84/1.19–1.22, 1.24–1.26; 364/718, 721, 851

[56] References Cited

U.S. PATENT DOCUMENTS 3,992,971 11/1976 Chibana et al. ..... 84/1.11

4,018,121 4/1977 Chowning ..... 84/1.01

*Primary Examiner*—S. J. Witkowski

*Attorney, Agent, or Firm*—Cushman, Darby & Cushman

[57] ABSTRACT

The generating function $\cos[Z(t)\cdot\sin(\omega' t)]$ of Bessel functions is utilized as a modulating function for a fundamental function $\sin(\omega t)$ in synthesis of a musical tone including many harmonic (over tone) components, wherein $Z(t)$ is used as a modulating index. The modulating frequency $\omega'$ in $\sin(\omega' t)$ of the modulating function $\cos[Z(t)\cdot\sin(\omega' t)]$ is selected relative to the fundamental frequency so that $w'=n\omega$ wherein n is a half integer or an irrational number.

47 Claims, 24 Drawing Figures

$F(\omega t)=\sin\omega t,\ \omega'=\frac{1}{2}\omega,\ Z(t)=\frac{\pi}{8}$ $F(\omega t)=\sin\omega t,\ \omega'=\frac{1}{2}\omega,\ Z(t)=\frac{\pi}{2}$ $F(\omega t)=\sin\omega t,\ \omega'=\frac{1}{2}\omega,\ Z(t)=\pi$

METHOD OF SYNTHESIZING MUSICAL TONES

This application is a continuation of the last filed of the following sequentially copending continuations, all now abandoned: Ser. No. 759,936, filed July 29, 1985; Ser. No. 656,422, filed Oct. 2, 1984; Ser. No. 600,595, filed Apr. 16, 1984; Ser. No. 544,063, filed Oct. 23, 1983; Ser. No. 410,841, filed Aug. 23, 1982; Ser. No. 300,193, filed Sept. 8, 1981; Ser. No. 152,306, filed May 22, 1980; Ser. No. 066,285, filed Aug. 13, 1979, and Ser. No. 842,325, filed Oct. 14, 1977.

BACKGROUND OF THE INVENTION (a) Field of the Invention

The present invention relates to a method of synthesizing a musical tone composed of a plurality of frequency components, and more particularly it pertains to a method of synthesizing a musical tone by the mathematical (arithmetic) operations (calculations) using a limited amount of information.

(b) Description of the Prior Art

Musical tone has a waveshape formed of a plurality of harmonic frequency components. Thus, one of the most popular methods of synthesizing a musical tone utilizes the expansion in Fourier series $$N(t) = \sum_{n=1}^{N} C_n \cdot \sin(n\omega t).$$

This method is theoretically excellent, but has the disadvantage that the number N of terms should be increased considerably large in case of synthesizing such musical tones as the piano tones or other percussive tones which include many harmonics. This means that very high speed mathematical (arithmetic) operations are required for synthesizing such musical tones and that the requirements for the operation device (function generators, etc.) become very severe. Furthermore, the controlling the color of each tone on a time basis, the coefficients $C_n$ of the respective harmonics should be varied on a time basis. Such control associated with the large number of expansion terms brings forth a further difficulty which can be solved only by an increased capacity of the operation system.

SUMMARY OF THE INVENTION

Therefore, an object of the present invention is to solve those problems encountered in the conventional art, and to provide a method of synthesizing musical tones which is capable of synthesizing a complicated waveshape of a musical tone by carrying out simple operations by the use of a limited amount of information.

Another object of the present invention is to provide a method of synthesizing musical tones which is capable of generating percussive tones having sharp attack.

According to the basic concept of the present invention, a musical tone, which is a function of time N(t), is synthesized by the formula:

$$N(t)=F(\omega t)\cdot\cos\,[Z(t)\cdot\sin\,(\omega' t)] \qquad (1),$$

wherein: $F(\omega t)$ represents a basic periodic function in the audio frequency range to be subjected to modulation; $\cos\,[Z(t)\cdot\sin\,(\omega' t)]$ represents a modulating function; and Z(t) represents a function of time (referred to hereinafter as a modulation index) for determining the depth of modulation and defining the time-based expansion of the spectrum distribution of the musical tone N(t). The basic periodic function is usually formed with a sinusoidal function of a constant amplitude and a constant angular frequency $\omega$. The tone signal represented by Equation (1) can include many harmonic (over tone) components or partials as can be seen by the expansion in the Bessel functions:

$$\cos[Z\cdot\sin(\omega' t)] = J_0(Z) + 2\sum_{m=1}^{\infty} J_{2m}(Z)\cdot\cos(2m\omega' t), \qquad (2)$$

wherein: $J_{2m}$ represents the 2m-th Bessel function of the first kind.

DETAILED DESCRIPTION OF THE PREFERRED EMBODIMENTS

Figure 1:
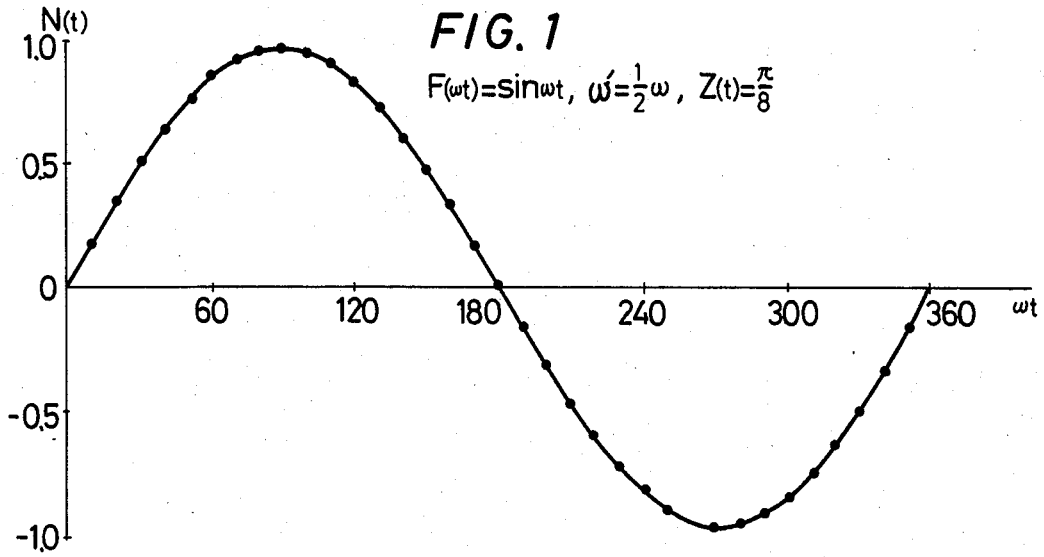
FIGS. 1 to 17 are diagrams showing examples of tone waveshapes synthesized by the single term modulation according to an embodiment of the present invention.
Figure 2:
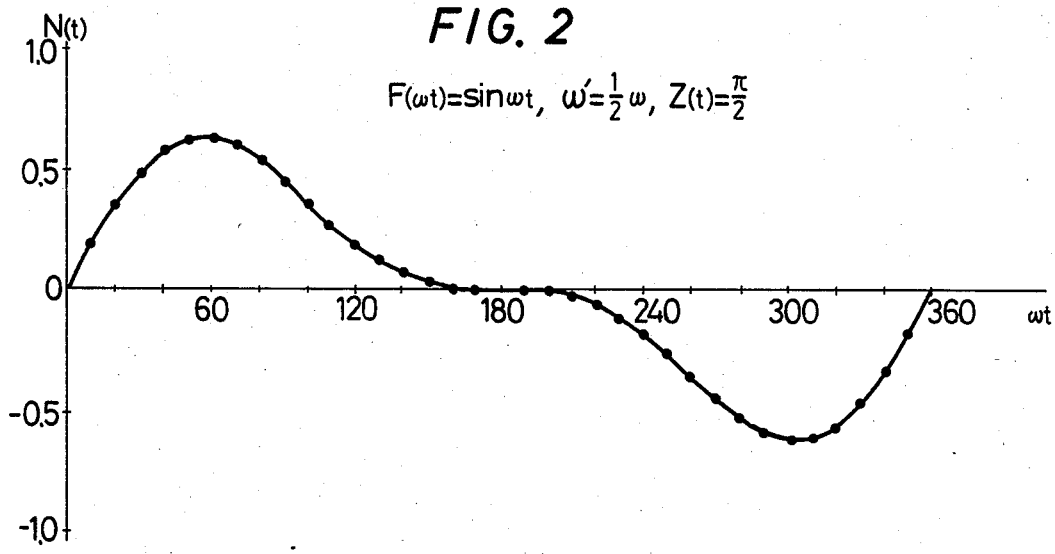
Figure 3:
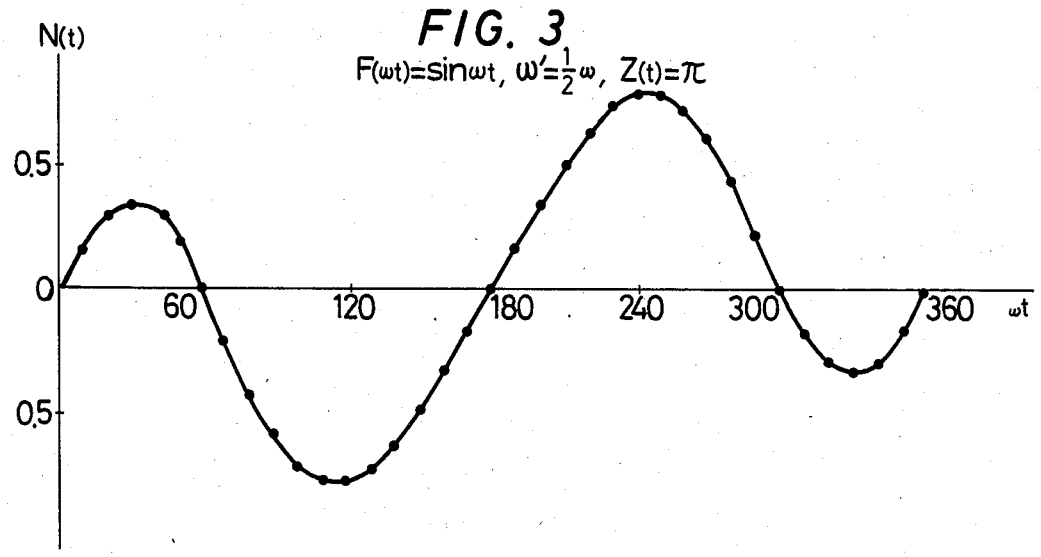
Figure 4:
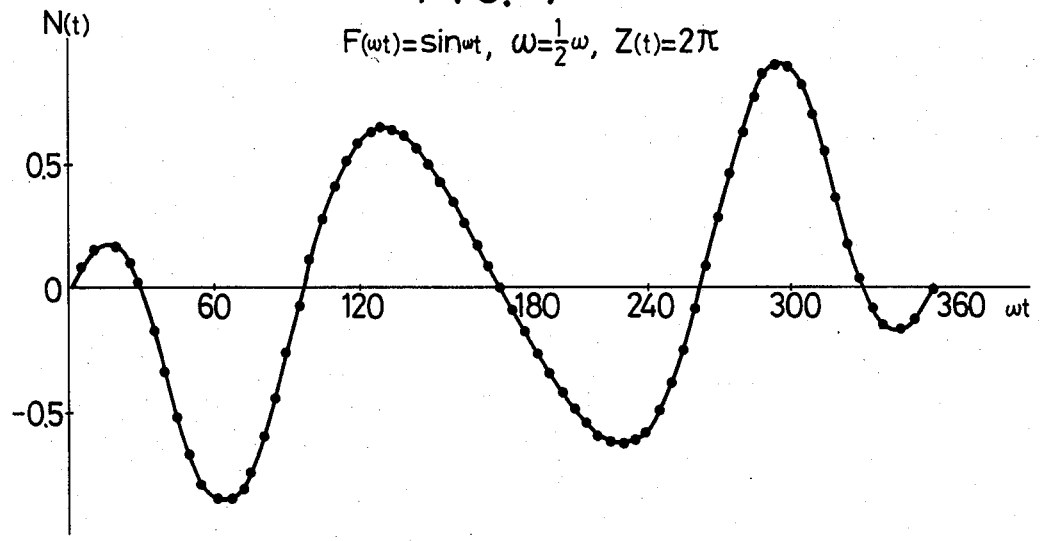
Figure 5:
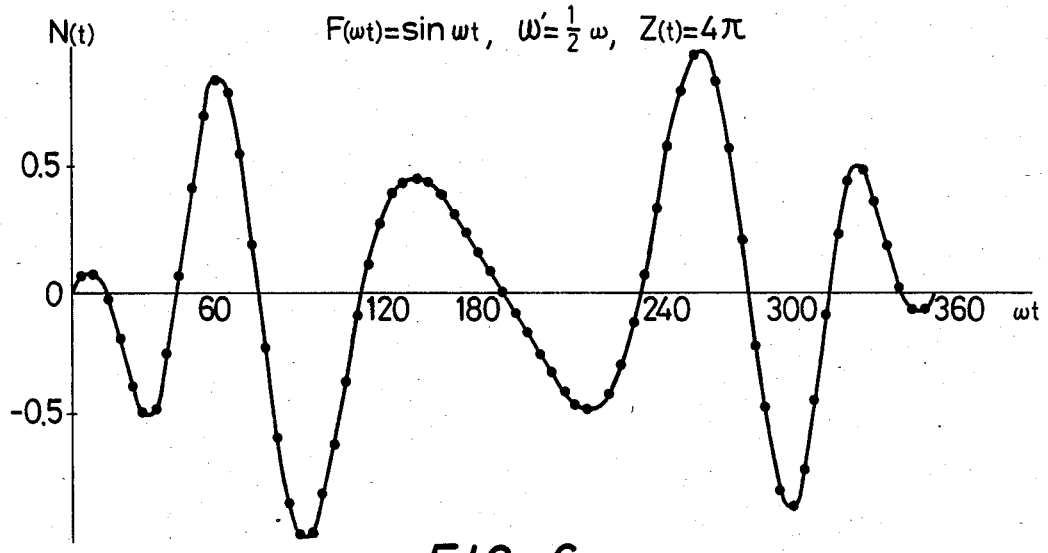
Figure 6:
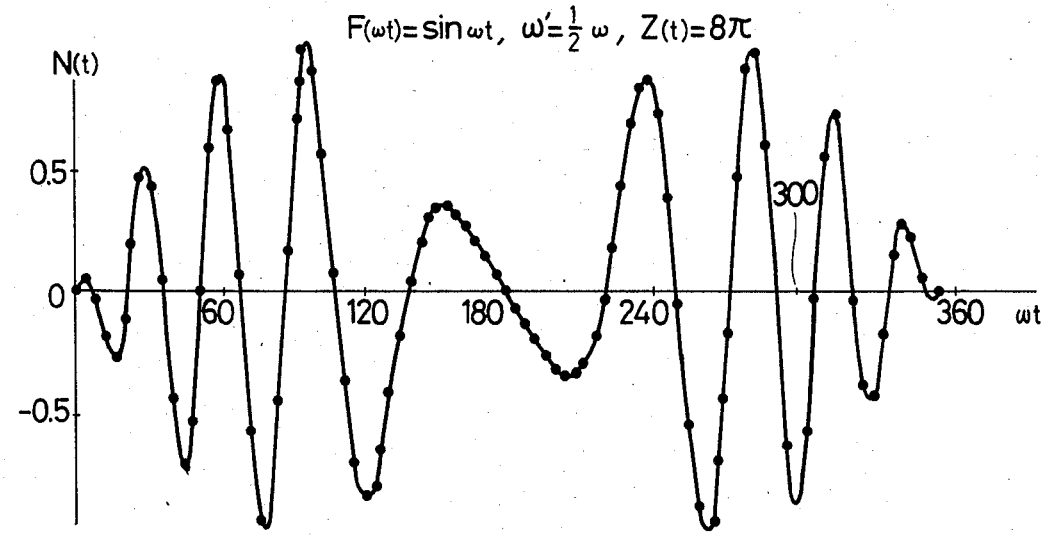
Figure 7:
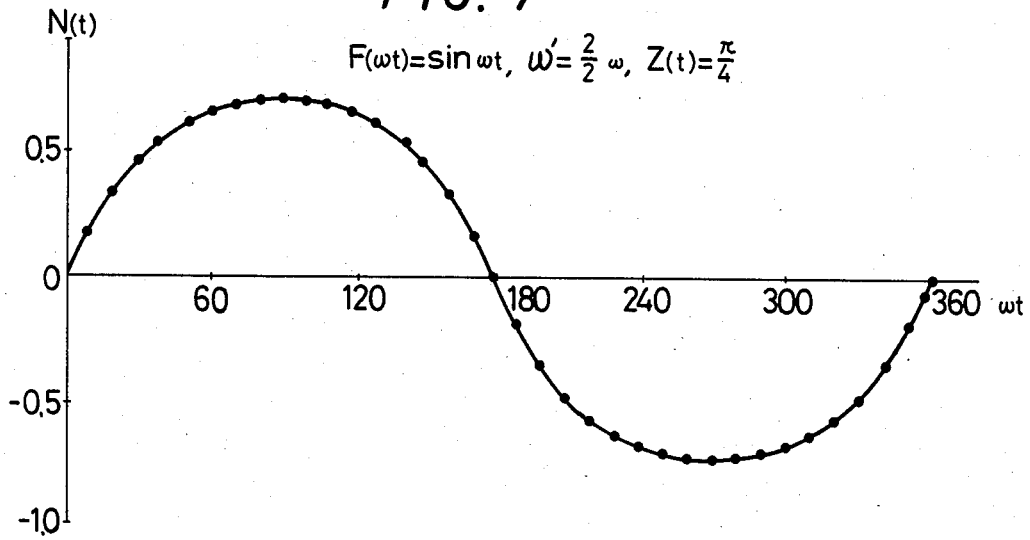
Figure 8:
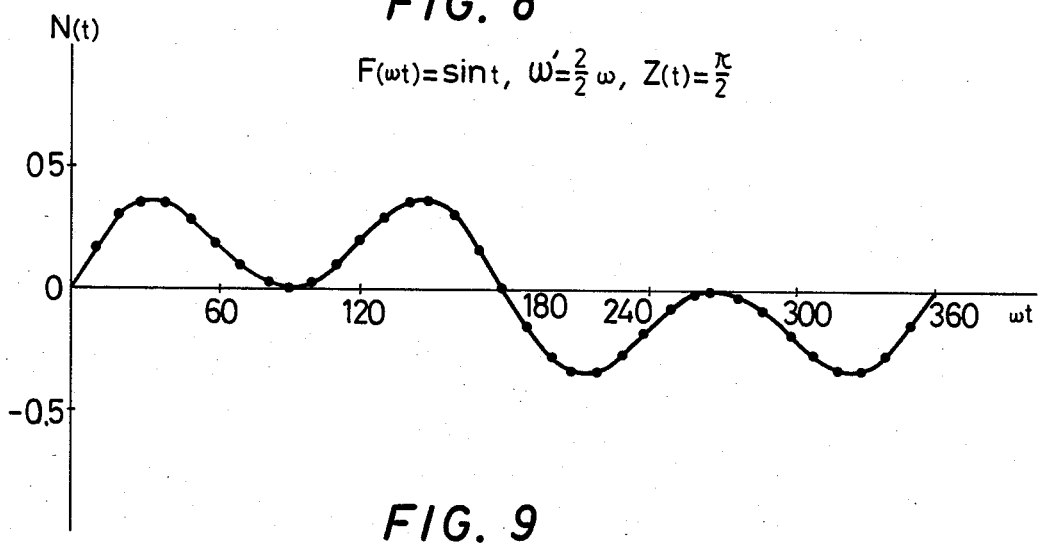
Figure 9:
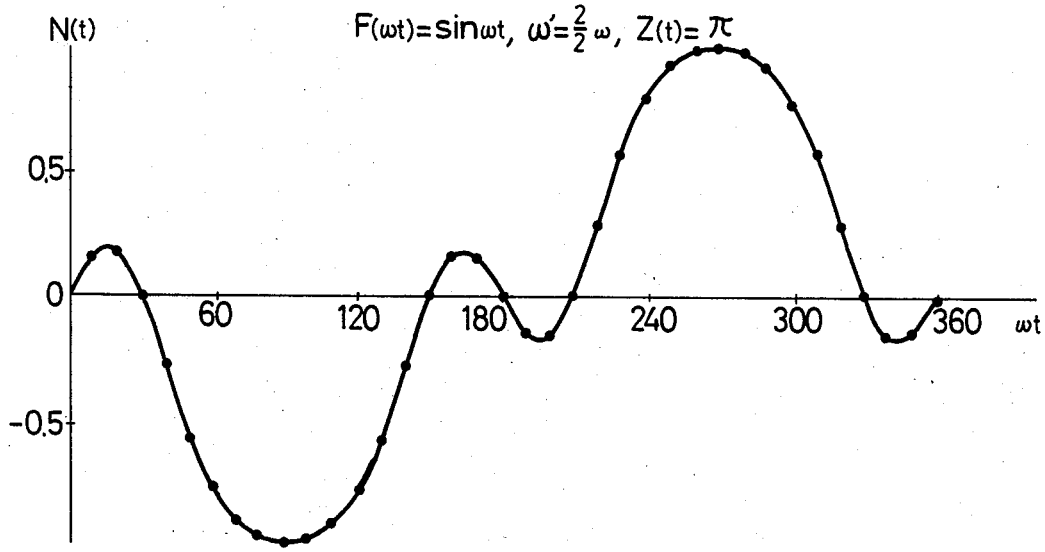
Figure 10:
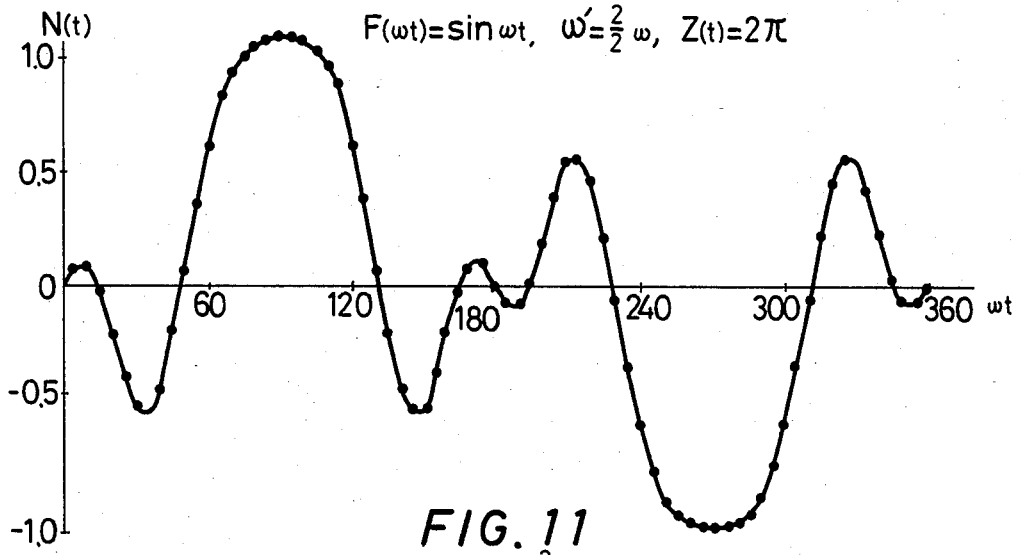

According to a preferred embodiment of the present invention, a musical tone is synthesized in accordance with Formula (1).

For example, when the basic function and the modulating frequency are selected to be $F(\omega t)=\sin(\omega t)$ and $\omega'=\omega/2$, respectively, Formula (1) may be rewritten by the use of Equation (2) as $$\begin{aligned} N(t) &= \sin(\omega t)\cdot\cos[Z\cdot\sin(\omega t/2)] = \\ &\sin(\omega t)\cdot[J_0(Z) + 2J_2(Z)\cos(\omega t) + 2J_4(Z)\cos(2\omega t)\ldots + \\ &2J_{2k}(Z)\cos(k\omega t) + \ldots] = \\ &[J_0(Z) - J_4(Z)]\sin(\omega t) + [J_2(Z) - J_6(Z)]\sin(2\omega t) + \\ &[J_4(Z) - J_8(Z)]\sin(3\omega t) + \ldots + \\ &[J_{2(k-1)}(Z) - J_{2(k+1)}(Z)]\sin(k\omega t) + \ldots. \end{aligned} \qquad (3)$$

Here, the well-known formulae:

$$2\sin(\alpha)\cdot\cos(\beta)=\sin(\alpha+\beta)+\sin(\alpha-\beta),$$

and $$\sin(\alpha-\beta)=-\sin(\beta-\alpha) \qquad (4)$$

are used. From Equation (3), it can be seen that a combination of the basic function sin ($\omega t$) and its harmonics sin ($k\omega t$) is provided. The expansion coefficient (i.e. amplitude) of the k-th harmonic is given by $[J_{2(k-1)}(Z)-J_{2(k+1)}(Z)]$ which value is determined by the modulation index Z. The modulation index Z may be a function of time Z(t). Thus, when the modulation index Z is set as a function of time, the respective frequency components of the tone waveshape N(t) will vary with time. FIGS. 1 to 6 show the tone waveshape N(t) when the modulation index Z is set at $\pi/8$, $\pi/2$, $\pi$, $2\pi$, $4\pi$, and $8\pi$. As can be seen from the figures, the tone waveshape N(t) can be varied in a wide range by varying the modulation index Z(t). In other words, the time-based variation of the spectrum distribution of the tone waveshape N(t) can be controlled by setting the modulation index Z as an appropriate function of time Z(t).

The modulation frequency $\omega'$ in the modulating function cos [Z·sin ($\omega' t$)] is not limited to $\omega/2$, but may also be selected in other ways. Here, it can be seen from Equations (1), (2) and (4) that the modulating frequency $\omega'$ in cos [Z·sin ($\omega' t$)] determines the fundamental frequency modulus $2\omega'$ in the expansion in Bessel functions, and that each expansion term with a frequency $2k\omega'$, when combined with the basic function, appears in two terms having frequencies $\omega$ higher and lower than $2k\omega'$, i.e. ($2k\omega' \pm \omega$).

In case when the basic function F($\omega t$) and the modulating frequency $\omega'$ are selected as F($\omega t$)=sin ($\omega t$) and $\omega'=\omega$, then Equation (1) will become:

$$\begin{aligned} N(t) &= \sin(\omega t)\cdot\cos[Z\cdot\sin(\omega)t] = \\ &\sin(\omega t)\cdot[J_0(Z)+2J_2(Z)\cos(2\omega t)+2J_4(Z)\cos(4\omega t)+\ldots+ \\ &2J_{2k}(Z)\cdot\cos(2k\omega t)+\ldots] = \\ &[J_0(Z)-J_2(Z)]\sin(\omega t)+[J_2(Z)-J_4(Z)]\sin(3\omega t)+\ldots+ \\ &[J_{2k}(Z)-J_{2(k+1)}(Z)]\sin[(2k+1)\omega t]+\ldots. \end{aligned} \tag{5}$$

Thus, when the fundamental frequency $\omega$ and the modulating frequency $\omega'$ are selected to be equal, only the odd order harmonic terms appear. FIGS. 7 to 10 show the tone waveshapes N(t) of Equation (5) when the modulation index Z is selected to be $\pi/4$, $\pi/2$, $\pi$, and $2\pi$.

In case when the basic function F($\omega t$) and the modulating frequency $\omega'$ are selected as F($\omega t$)=sin ($\omega t$) and $\omega'=1.5\omega$, the Equation (1) will become:

$$\begin{aligned} N(t) &= \sin(\omega t)\cdot\cos[Z\cdot\sin(1.5\omega t)] = \\ &\sin(\omega t)\cdot[J_0(Z)+2J_2(Z)\cos(3\omega t)+2J_4(Z)\cos(6\omega t)+\ldots+ \\ &2J_{2k}(Z)\cdot\cos(3k\omega t)+\ldots] = \\ &J_0(Z)\cdot\sin(\omega t)-J_2(Z)\cdot\sin(2\omega t)+J_2(Z)\cdot\sin(4\omega t)- \\ &J_4(Z)\cdot\sin(5\omega t)+J_4(Z)\cdot\sin(7\omega t)+\ldots- \\ &J_{2k}(Z)\cdot\sin[(3k-1)\omega t]+J_{2k}(Z)\cdot\sin[(3k+1)\omega t]+\ldots. \end{aligned} \tag{6}$$

Figure 11:
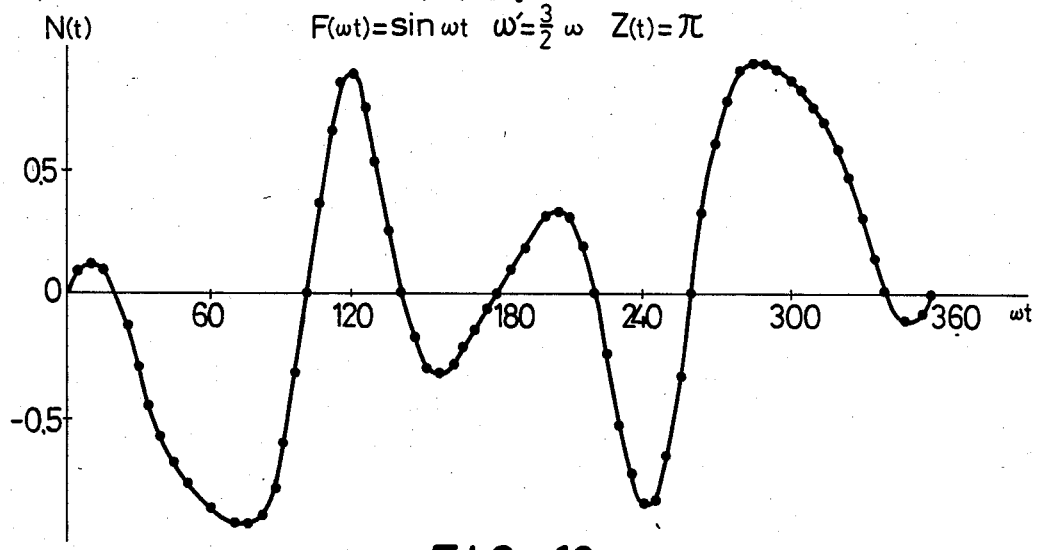

In this case, the 3k-th harmonic components are lacking. The tone waveshape N(t) of Equation (6) when the modulation index Z is selecrted to be $\pi$ is shown in FIG. 11.

Similarly, when the basic function F($\omega t$) and the modulating frequency $\omega'$ are selected to be F($\omega t$)=sin ($\omega t$) and $\omega'=2\omega$, only the odd order harmonic terms appear as:

$$\begin{aligned} N(t) &= J_0(Z)\cdot\sin(\omega t)-J_2(Z)\cdot\sin(3\omega t)+J_2(Z)\cdot\sin(5\omega t)- \\ &J_4(Z)\cdot\sin(7\omega t)+J_4(Z)\cdot\sin(9\omega t)-\ldots- \\ &J_{2k}(Z)\cdot\sin[(4k-1)\omega t]+J_{2k}(Z)\cdot\sin[(4k+1)\omega t]-\ldots. \end{aligned} \tag{7}$$

Figure 12:
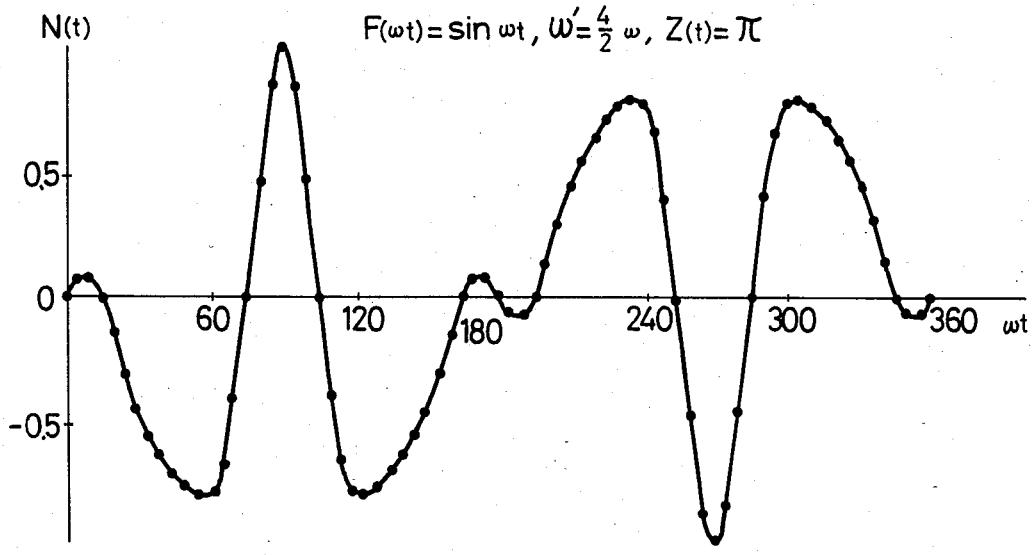
Figure 13:
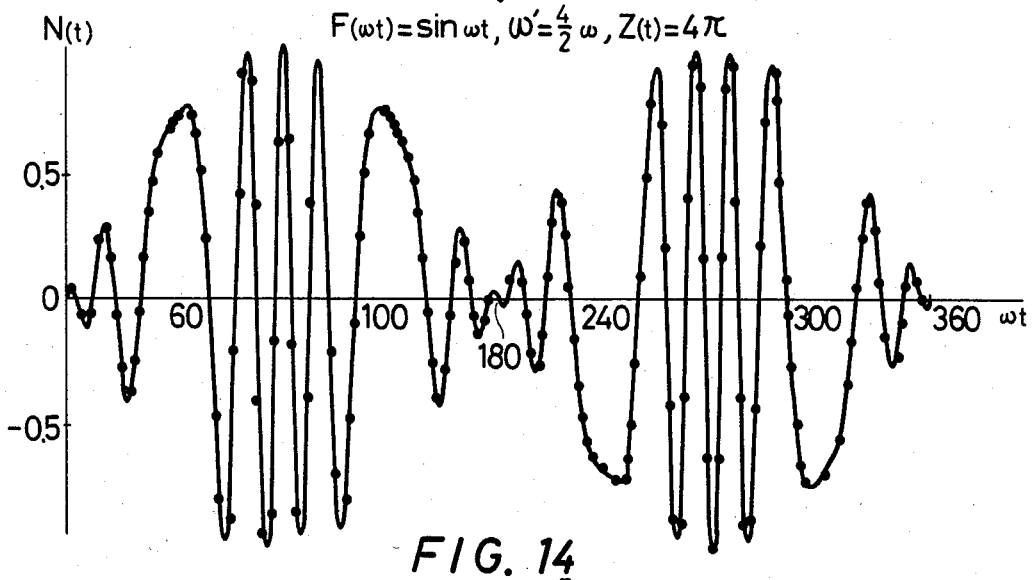

FIGS. 12 and 13 show the waveshapes of such case when the modulation index Z is selected to be $\pi$ and $4\pi$, respectively.

Figure 14:
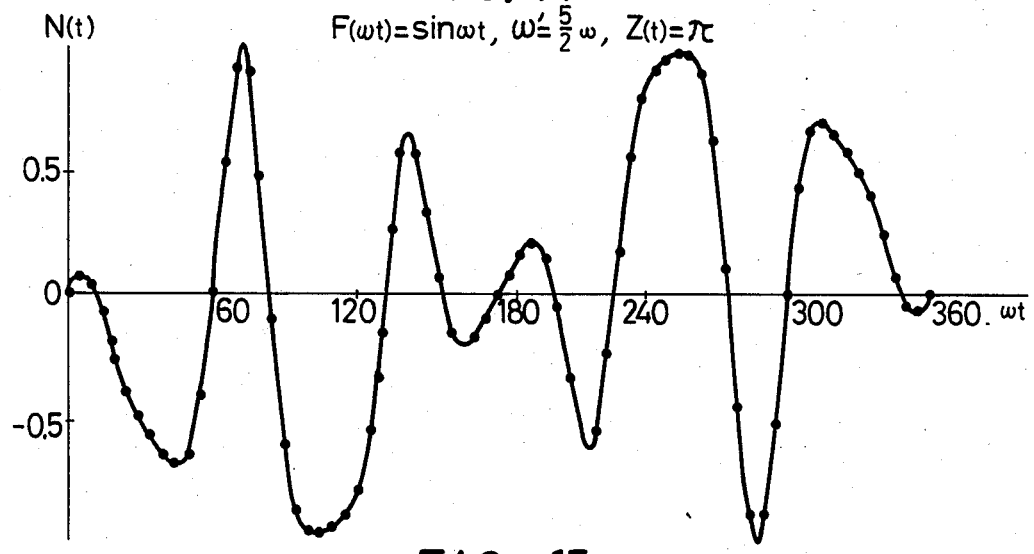

FIG. 14 shows the waveshape for another case when F($\omega t$)=sin ($\omega t$), $\omega'=2.5\omega$ and $Z=\pi$.

In the above examples, the ratio of the modulation frequency $\omega'$ to the fundamental frequency was set as an integer or a half integer. Therefore, the left hand side of Equation (1), when expanded in sinusoidal functions as in Equation (2), will contain only the integral harmonic terms. In other words, the tone signal N(t) which comprises harmonic spectrum may be said to be periodic in the range of $0 \leqq \omega t \leqq \pi$.

Now, consideration will be made on the case when the ratio of the modulating frequency $\omega'$ to the fundamental frequency $\omega$ is set as a non-half-integer (particularly an irrational) number.

For example, when F($\omega t$)=sin ($\omega t$) and $\omega'=(\sqrt{2}/2)\omega$, Equation (1) will become:

$$\begin{aligned} N(t) &= \sin(\omega t)\cdot\cos\left[Z\cdot\sin\left(\frac{\sqrt{2}}{2}\omega t\right)\right] \\ &= \sin(\omega t)\cdot\left[J_0(Z)+2\sum_{m=1}^{\infty}J_{2m}(Z)\cdot\cos(\sqrt{2}\,m\omega t)\right] \\ &= J_0(Z)\cdot\sin(\omega t)+J_2(Z)\cdot[\sin(2.414\,\omega t)-\sin(0.414\,\omega t)]+ \\ &\quad J_4(Z)\cdot[\sin(3.828\,\omega t)-\sin(1.828\,\omega t)]+\ldots \\ &= -J_2(Z)\cdot\sin(0.414\,\omega t)+J_0(Z)\cdot\sin(\omega t)- \\ &\quad J_4(Z)\cdot\sin(1.828\,\omega t)+J_2(Z)\cdot\sin(2.414\,\omega t)- \\ &\quad J_6(Z)\cdot\sin(3.242\,\omega t)+J_4(Z)\cdot\sin(3.828\,\omega t)\ldots. \end{aligned} \tag{8}$$

Figure 15:
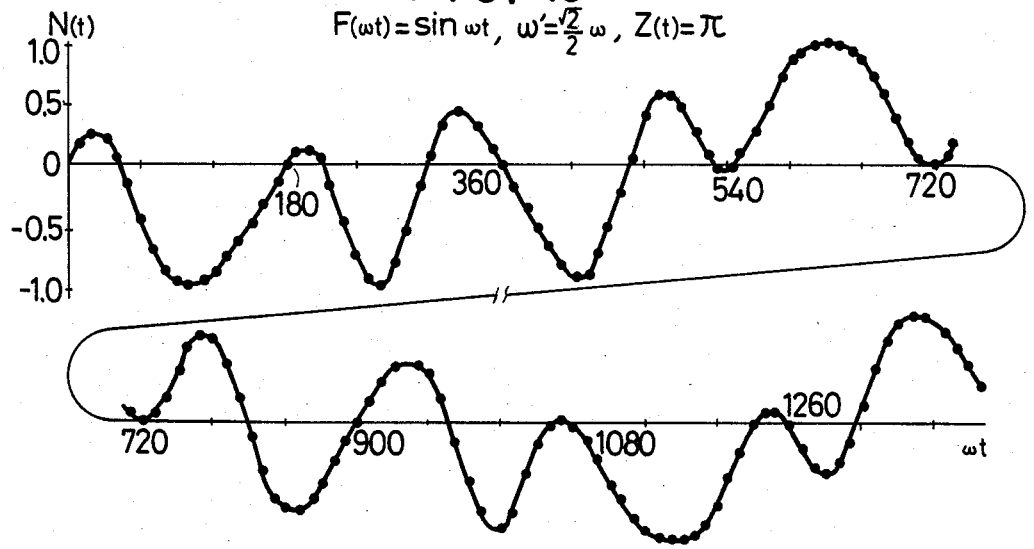
Figure 16:
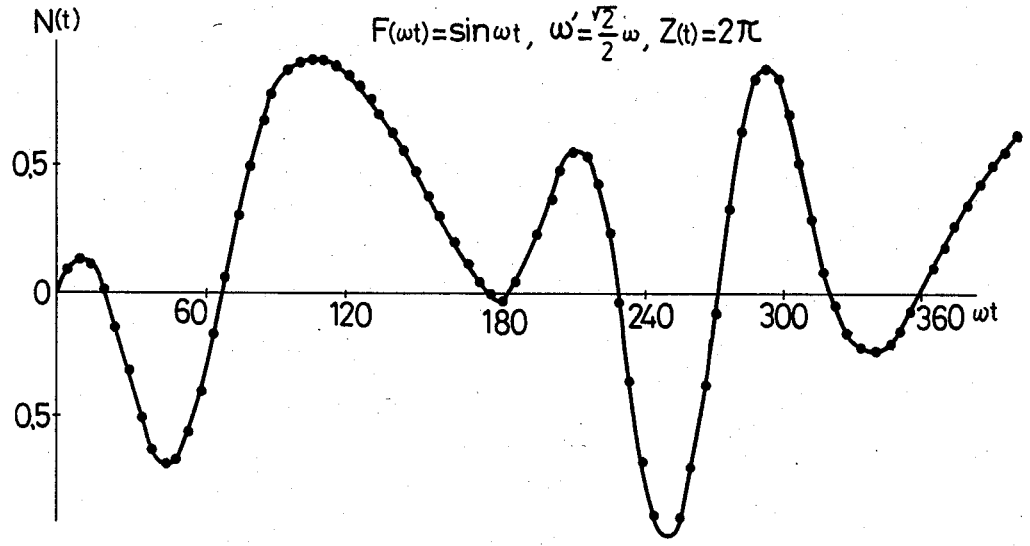
Figure 17:
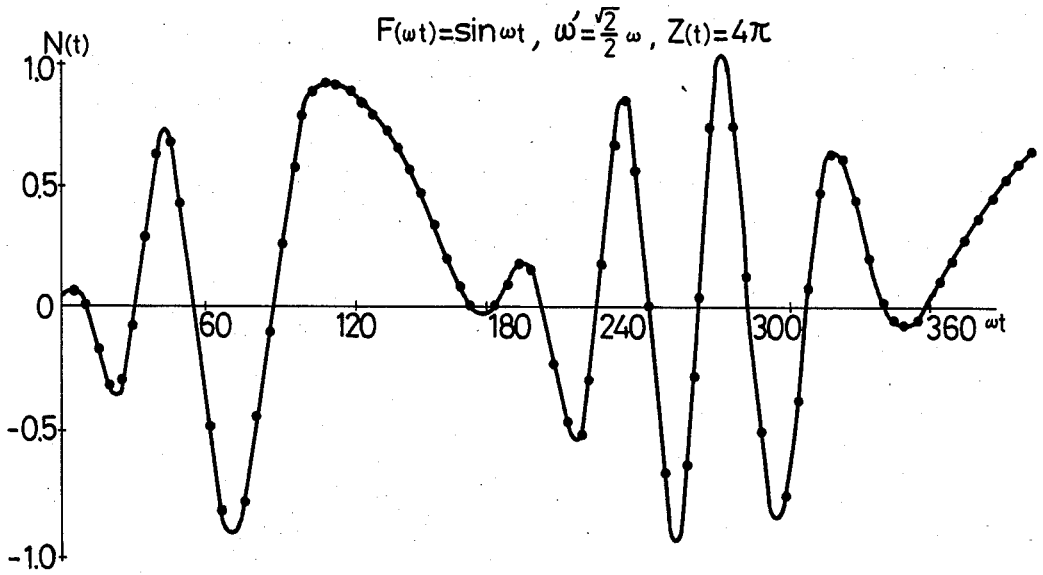

The waveshapes of N(t) in case Z is set at $\pi$, $2\pi$ and $4\pi$ in this case are shown in FIGS. 15 to 17.

As can be seen from the above example, when the frequency $\omega'$ is selected to be an irrational number times as large as the fundamental frequency $\omega$, the musical tone N(t) will have a nonharmonic spectrum with no periodicity. Namely, when the ratio of the frequencies $\omega'$ to $\omega$ is selected at an irrational number, a musical tone comprising non-harmonic partial tones can be easily provided. This is very advantageous for synthesizing such musical tones as those of percussive instruments. Practically, the ratio of the modulating frequency $\omega'$ to the fundamental frequency $\omega$ may be a non-half-integer, complicated, rational number for avoiding periodicity and providing non-harmonic spectrum since the amplitude and the modulating index Z(t) will vary sharply with time in the case of percussive tones.

FIGS. 15 to 17 show the musical tone waveshapes for the cases of F($\omega t$)=sin ($\omega t$), $\omega'=\sqrt{2}/2\omega$ and $Z=\pi$, $2\pi$ and $4\pi$.

The above embodiment utilizes a single term cos [Z·sin ($\omega' t$)] for the modulation of F($\omega t$). The more generalized forms of the tone signal modulation of the present invention are:

$$N(t) = F(\omega t)\sum_{m=1}^{M}\cos[Z_m(t)\cdot\sin(\omega'_m t)] \tag{9}$$

and,

-continued $$N(t) = F(\omega t) \prod_{m=1}^{M} \cos[Z_m(t) \cdot \sin(\omega'_m t)], \quad (10)$$

wherein: a plurality of modulation terms cos $[Z_m(t) \cdot \sin(\omega'_m t)]$ are summed (or integrated), or multiplied.

According to Formula (9), a plurality of families of the partial tones, each family corresponding to Formula (1), are summed. Since the respective parameters $Z_m(t)$ and $\omega'_m$ can be selected independently, the freedom for controlling the spectrum of the tone N(t) is increased.

For example, in the case of M=2 (double term modulation), the first term (m=1) may be selected to give tone component $N_1(t)$ having harmonic spectrum and a periodicity, while the second term (m=2) may be selected to give tone component $N_2(t)$ having non-harmonic spectrum. This can be achieved by selecting $\omega_1'=(n/2)\omega$ and $\omega_2'=r\omega$ wherein n represents an integer and r represents a non-half-integer (particularly an irrational) number. Furthermore, if the modulation index $Z_2(t)$ is set so as to enhance $N_2(t)$ component at the attack and to gradually decay it off with the lapse of time, such musical tones as resembling piano or guitar sounds can be synthesized, which contain considerable amount of non-harmonic partial tones in the attack.

Still further, musical tones may be synthesized by further modulation mode;

$$N(t) = \sum_{m=1}^{M} B_m \cdot \sin(m\omega t) \cdot \cos[Z_m(t) \cdot \sin(\omega_m' t)]. \quad (11)$$

This synthesizing system (11) has the advantage that the color control of the musical tone N(t) is easy. Namely, the color of a tone is determined by the levels of the respective harmonics. Especially, the tone color is largely dominated by the levels of the lower harmonics. The individual levels of the higher harmonics do not give much influence to the tone color, but only the general or total level of the higher harmonics will give some influence to the tone color. According to Formula (11), the individual levels of the lower harmonics which mainly determine the tone color may be set by the coefficients $B_m$ and m, while the overall level of the higher harmonics may be set by the modulation index $Z_m(t)$. Then, musical tones of arbitrary color can be synthesized.

The multiple modulation represented by Formula (10) takes the form of multiplication of the modulation function of Formula (1), and can provide a further complicated musical tone N(t) which is rich in variation.

As an example, double multiplication modulation (M=2) will be described.

When $F(\omega t)=\sin(\omega t)$, $\omega_1'=\frac{1}{2}\omega$ and $\omega_2'=\frac{1}{2}\omega$, Formula (10) can be expanded as:

$$\begin{aligned} N(t) &= \sin(\omega t) \cdot \cos[Z_1(t) \cdot \sin(\tfrac{1}{2}\omega t)] \cdot \cos[Z_2(t) \cdot \sin(\tfrac{1}{2}\omega t)] \quad (12) \\ &= [\{J_0(Z_1) - J_4(Z_1)\}\{J_0(Z_2) - J_4(Z_2)\} + \\ &\{J_2(Z_1) - J_6(Z_1)\}\{J_2(Z_2) - J_6(Z_2)\} + \ldots] \cdot \sin(\omega t) + \\ &[\{J_0(Z_1) - J_4(Z_1)\}\{J_2(Z_2) - J_4(Z_2)\} + \\ &\{J_2(Z_1) - J_6(Z_1)\}\{J_0(Z_2) - J_6(Z_2)\} + \ldots] \cdot \sin(2\omega t) + \ldots . \end{aligned}$$

As will be appreciated, the individual harmonics have the amplitude represented by the sum of the second order terms of Bessel functions.

Figure 18:
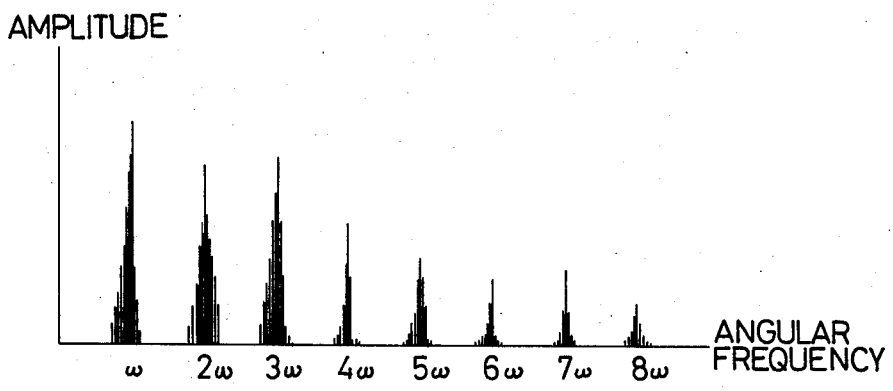
FIG. 18 is a diagram showing an example of the spectrum distribution of a musical tone synthesized according to an embodiment of the method of synthesizing a musical tone of the present invention.

If the degree of multiple modulation is increased to the third (M=3), fourth (M=4), . . . , then the amplitude of the individual harmonics will be the sum of the third, fourth, . . . order terms of Bessel functions. Musical tones having a spectrum rich in variation can be synthesized by appropriately selecting the parameters. Furthermore, the position of the peak in spectrum can be freely selected by the selection of the modulation frequencies $\omega_m'$, i.e. the selection of $n_m$ in $\omega_m'=n_m/2\omega$ wherein $n_m$ represents a real number. In other words, particular harmonics may be either enhanced or depressed. When the number $n_m$ is slightly shifted from a half-integer, non-integral order harmonics may be distributed around the integral order harmonics as shown in FIG. 18. Namely, line spectrum may be modified to a somewhat continuous spectrum. By such modulation, the individual harmonic components are allowed to vibrate in frequency on time-basis to provide more natural musical tones. Namely, the multi-source effect or the chorus effect can be provided.

Figure 19:
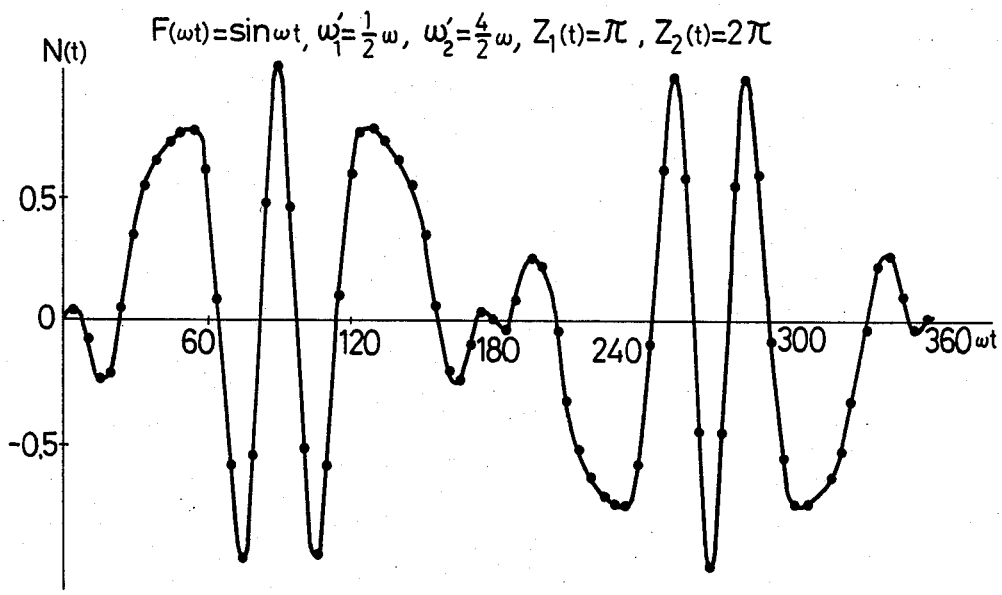
FIG. 19 is a diagram showing an example of the tone waveshape synthesized by the two-terms modulation according to another embodiment of the present invention.

FIG. 19 shows an example of double modulation in the case of $F(\omega t)=\sin(\omega t)$, M=2, $\omega_1'=\frac{1}{2}\omega$, $\omega_2'=4/2\omega$, $Z_1(t)=\pi$ and $Z_2(t)=2\pi$.

Next, description will be made on an example of an electronic musical instrument for carrying out the musical tone synthesis of the present invention.

Figure 20:
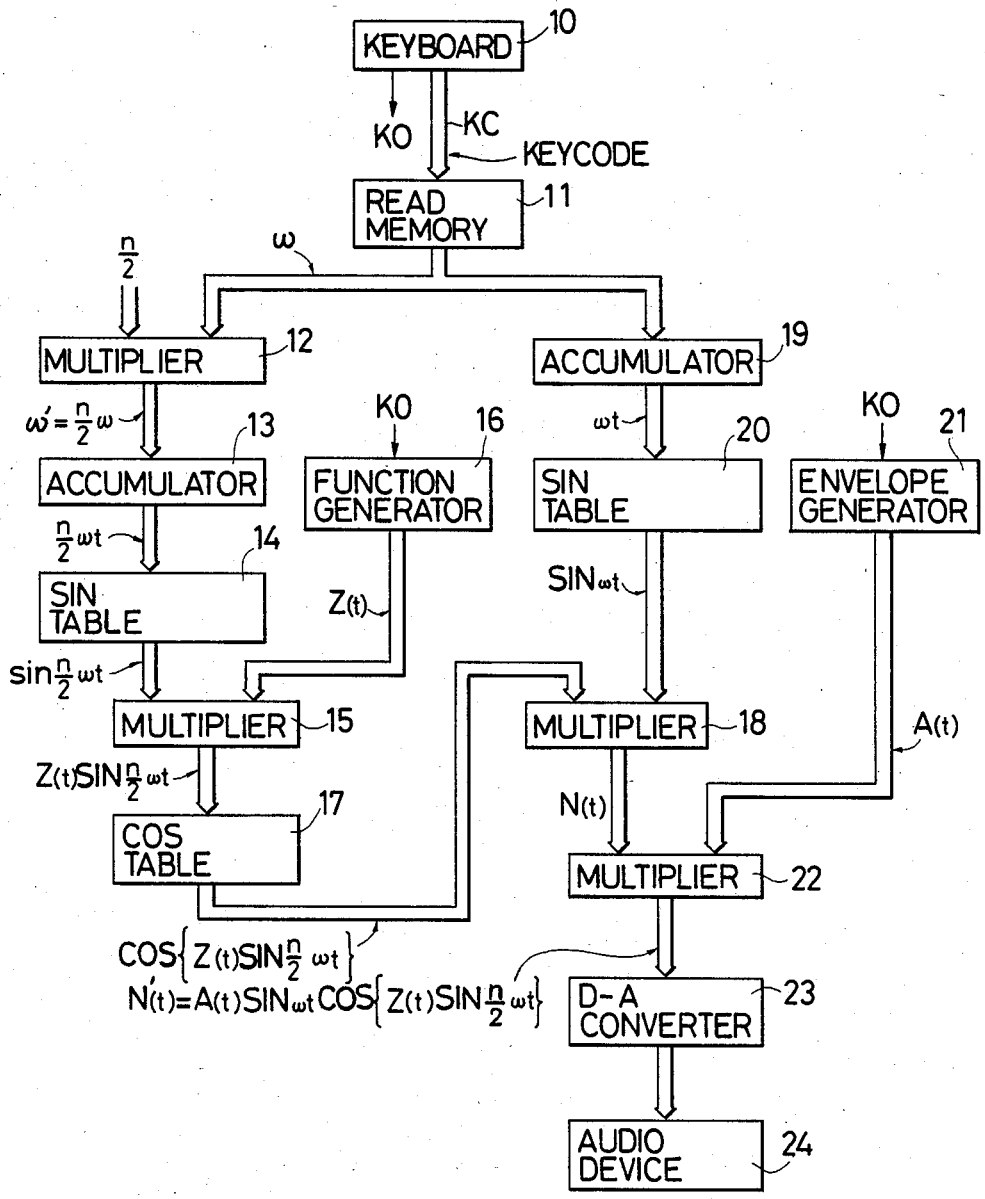
FIG. 20 is a block diagram showing an example of a digital electronic musical instrument for carrying out the method of synthesizing a musical tone according to the present invention.

FIG. 20 shows an example of a digital type electronic musical instrument for synthesizing musical tones according to the single term modulation Formula (1) or the general multiple term modulation Formula (10) (wherein M=1). A keyboard circuit 10 generates an associated key code signal KC in response to a depressed key. A read-only-memory (ROM) 11 stores the basic frequency information $\omega$ corresponding to the respective keys and supplies frequency information $\omega$ corresponding to the key code KC. A multiplier 12 multiplies the information n/2 with the above frequency information $\omega$ to provide the modulating frequency information $n/2\omega$ to an accumulator 13. This information $n/2\omega$ is cumulatively integrated in the accumulator 13 at every operation clock to generate phase information $n/2\omega t$. Sine value, sin $(n/2\omega t)$, corresponding to this phase information is read out from a sine table (e.g. ROM) 14 and inputted into a multiplier 15. Furthermore, a key-on signal KO is generated from the keyboard 10 in response to the key depression and is supplied to a function generator 16 which, in turn, supplies the modulation index information Z(t) to the multiplier 15. Then, the multiplier 15 takes the product of Z(t) and sin $((n/2)wt)$, and addresses a cosine table (e.g. ROM) 17 to send cos $[Z(t) \cdot \sin(n/2\omega t)]$ to a multiplier 18. On the other hand, an accumulator 19 cumulatively adds the angular frequency information $\omega$ in synchronism with the operation clock to provide the phase information $\omega t$. In accordance with this phase information $\omega t$, the fundamental function information sin $(\omega t)$ is read out from a sine table 20. This sine information sin $(\omega t)$ and the cosine information cos $[Z(t) \cdot \sin(n/2\omega t)]$ are multiplied in a multiplier 18 to provide $N(t)=\sin(\omega t) \cdot \cos[Z(t) \cdot \sin(n/2\omega t)]$. In this example, envelope information A(t) is generated in an envelope generator 21 based on the key-on signal KO. The envelope information A(t) is multiplied by the result of the operation, N(t), in a multiplier 22 to provide an envelope to the musical tone. The finished digital signal is converted to an analog signal in a digital-to-analog converter 23 and is sounded as a musical tone through audio means 24. The digital-to-analog converter 23 and the audio means 24 are of the known construction. They may also be integrated in a unitary structure.

Figure 21:
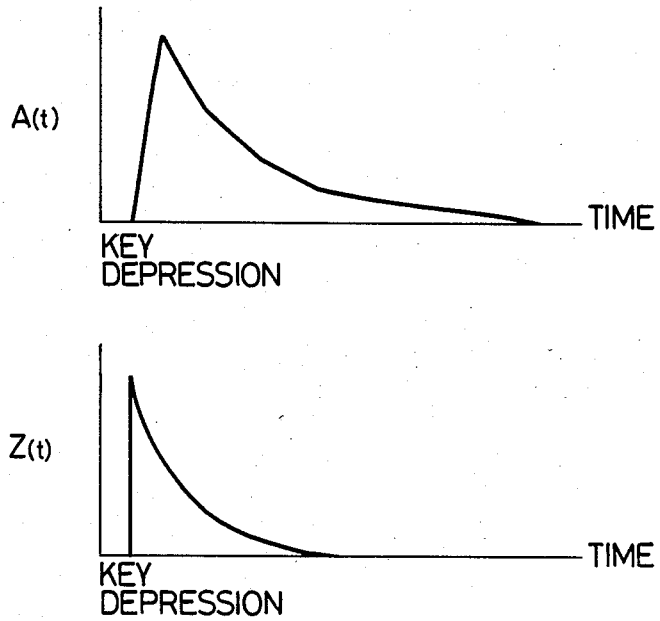
FIGS. 21 and 22 are diagrams showing examples of the envelope function A(t) and the modulation index Z(t).
Figure 22:
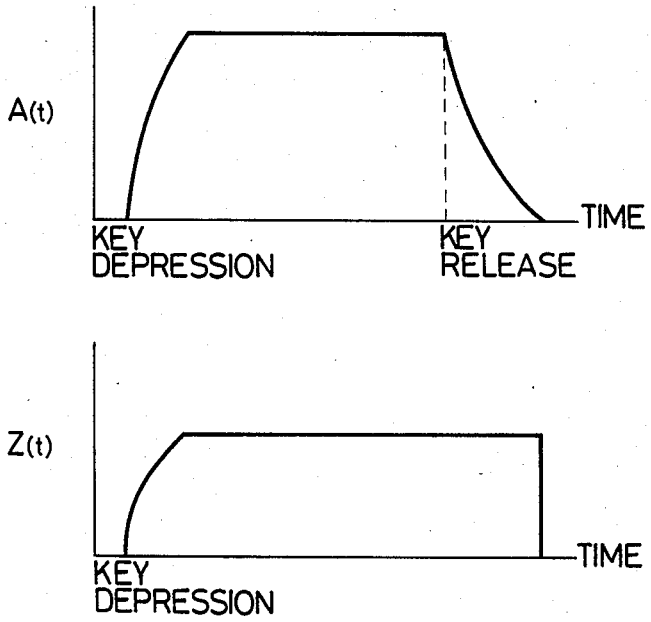

FIGS. 21 and 22 show examples of the envelope function A(t) and the modulation index function Z(t).

FIG. 21 shows a case for generating musical tones resembling attack musical tones such as piano tones. The musical tone sharply rises upon the commencement of key depression and gradually decays off thereafter. Furthermore, many higher harmonics are included immediately after the commencement of key depression, but they gradually decay off thereafter.

FIG. 22 shows a case for generating sustaining musical tones. A musical tone of approximately constant amplitude and tone color is generated during the key depression. The musical tone decays off upon the release of the key in accordance with a predetermined decay curve.

Figure 23:
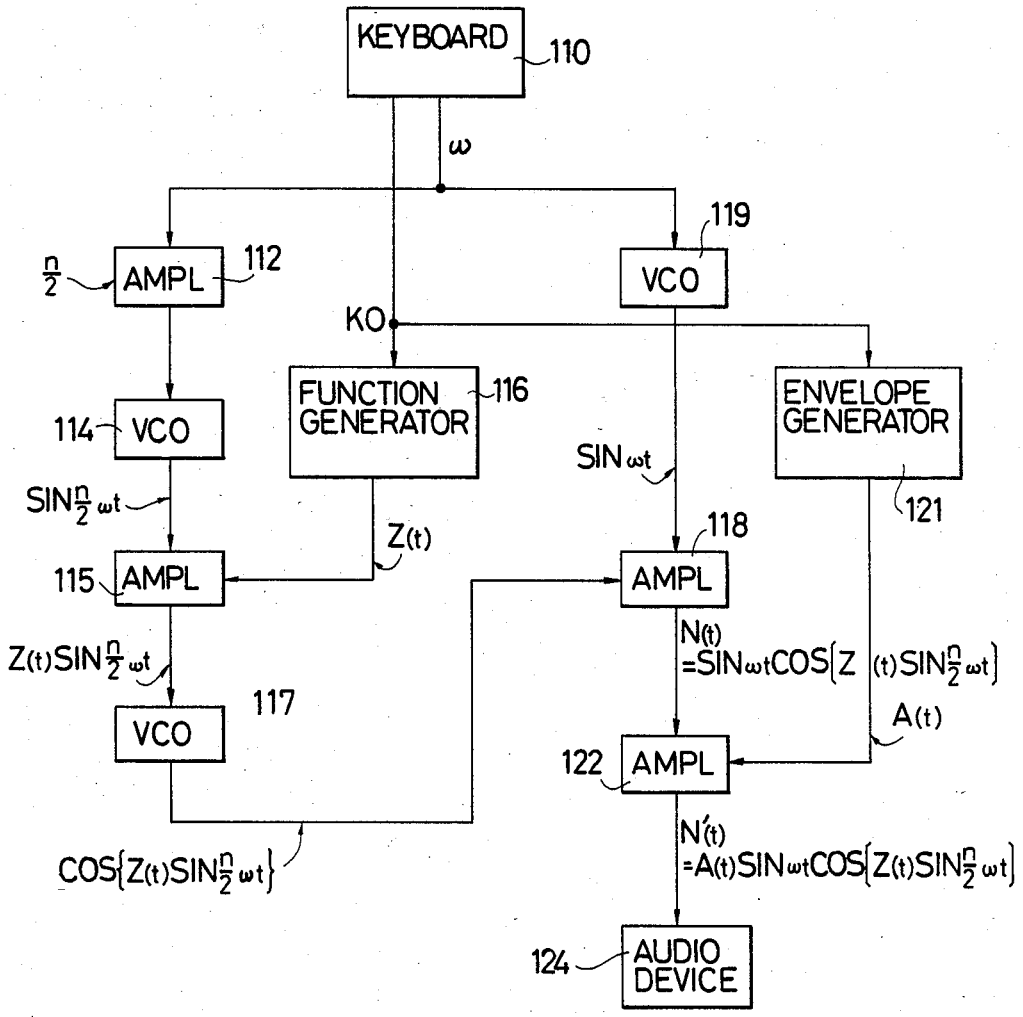
FIG. 23 is a block diagram showing an example of an analog electronic musical instrument for carrying out the method of synthesizing a musical tone according to the present invention.

FIG. 23 shows an example of the analog electronic musical instrument for carrying out similar performance to that of the electronic musical instrument of FIG. 20. A keyboard device 110 generates a voltage $\omega$ for determining the oscillation frequency to be subjected to modulation. This voltage $\omega$ is inputted into a variable gain amplifier 112, the gain of which is controlled by the voltage n/2. The output of this amplifier 112 is supplied to a voltage-controlled variable frequency oscillator 114 to control the oscillation frequency thereof. Then, the voltage-controlled oscillator 114 generates an oscillating signal of sin ($n\omega t/2$) and supplies it to a variable gain amplifier 115, the gain of which is controlled by the output voltage Z(t) of a function generator 116. Thus, the variable gain amplifier 115 generates an output signal of the form Z(t)·sin ($n\omega t/2$) and supplies it to a voltage-controlled variable frequency oscillator 117 to generate a modulated functin signal cos [Z(t)·sin ($n\omega t/2$)]. On the other hand, a voltage-controlled variable frequency oscillator 119 generates a fundamental function signal, sin ($\omega t$), to be subjected to modulation. This function signal sin ($\omega t$) is supplied to a variable gain amplifier 118, the gain of which is controlled by the output cos [Z(t)·sin ($n\omega t/2$)] of the voltage-controlled oscillator 117. Thus,the variable gain amplifier 117 provides a tone signal $N(t)=\sin(\omega t)\cdot\cos[Z(t)\cdot\sin(n\omega t/2)]$, thereby accomplishing the single term modulation. This tone signal N(t) is supplied to a variable gain amplifier 122, the gain of which is controlled by the envelope function voltage A(t) provided from an envelope generator 121. Thus, a tone signal $N'(t)=A(t)\cdot\sin(\omega t)\cdot\cos([Z(t)\cdot\sin(n\omega t/2)]$ afforded with the envelope modulation is provided, and is supplied to an audio device 124.

Figure 24:
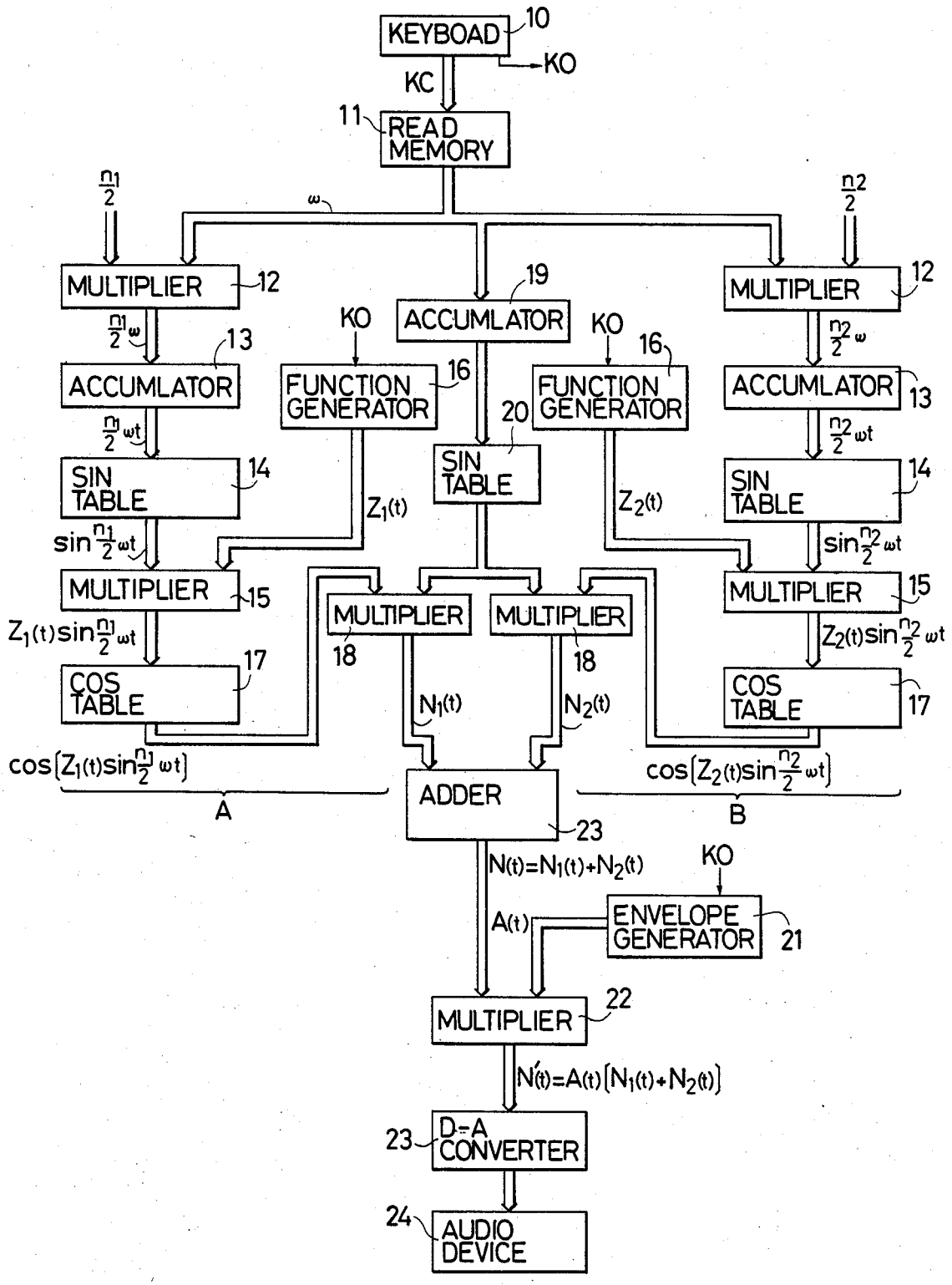
FIG. 24 is a block diagram showing another example of a digital electronic musical instrument for carrying out the method of synthesizing a musical tone according to the present invention.

FIG. 24 shows an example of a digital electronic musical instrument for generating musical tones according to two-terms modulation, i.e. formula (9) wherein M=2. In this example, the first term (m=1) and the second term (m=2) are calculated in a first calculation unit A and a second calculation unit B, respectively and the results of these two systems, $N_1(t)=\sin(\omega t)$. cos $[Z_1(t)\cdot\sin(n_1\omega t/2)]$ and $N_2(t)=\sin(\omega t)\cdot\cos[Z_2(t)\cdot\sin(n_2\omega t/2)]$ are added in an adder 23 to provide a tone signal $N(t)=N_1(t)+N_2(t)$. This tone signal N(t) is supplied to a multipler 22 and is multiplied by an envelope function A(t) provided from an envelope generator 21. Other blocks serve to achieve similar functions as those of the blocks of similar numerals in FIG. 20

Although separate calculation units A and B are provided for calculating different terms, similar functional parts in a single unit may be used commonly in time-sharing manner for calculating different terms.

The multiple modulation of Equation (10) may be achieved be arranging function blocks according to the order of operation of Formula (10), for example by replacing the adder 23 of FIG. 24 by a multiplier.

As will be apparent from the above descriptions, according to the musical tone synthesizing method of the present invention, tone signals are generated on the basis of the generating function of Bessel functions, and desired musical tones can be easily synthesized by using simple calculation means and by setting limited amount of information. The operation speed may be reduced as compared with the Fourier synthesis method due to the simplified operation. Therefore, simplification of the musical tone synthesizing system and reduction of the manufacturing cost are made possible.

What is claimed is:

1. A method of synthesizing a non frequency modulated musical tone signal comprising a plurality of frequencuy components utilizing the formula $N_i(t)=F(\omega t)\cos[Z\sin(\omega_i' t]$, wherein $\omega$ and $\omega'$ represent angular frequencies having a preselected ratio, t represents time and Z represents a modulating index, comprising:

arranging the modulating index Z as a function of time Z(t), and producing said non frequency modulated musical tone signal by modulating a basic signal represented by $F(\omega t)$ in only an amplitude sense, the modulating being by a modulated function signal represented by $\cos[Z(t)\sin(\omega' t)]$.

2. A method of synthesizing a musical tone signal according to claim 1, wherein: an envelope function $A_i(t)$ is further multiplied to $N_i(t)$.

3. A method of synthesizing a musical tone signal according to claim 2, wherein: said tone signal represented by N(t) is formed by the operation represented by $$N(t) = \sum_{i=1}^{M} A_i(t) \cdot N_i(t).$$

4. A method of synthesizing a musical tone signal according to claim 2 wherein: said tone signal represented by N(t) is formed by the operation represented by:

$$N(t) = \prod_{i=1}^{M} A_i(t) \cdot N_i(t).$$

5. A method of synthesizing a musical tone signal according to claim 1, wherein: the ratio of frequencies $\omega_i'/\omega$ is selected to be a half integer.

6. A method of synthesizing a musical tone signal according to claim 1, wherein: the ratio of frequencies $\omega_i'/\omega$ is selected at a value displaced from a half integer.

7. A method of synthesizing a musical tone signal according to claim 1, wherein: the ratio of frequencies $\omega_i'/\omega$ is selected to be an irrational number.

8. A method of synthesizing a musical tone signal according to claim 1, wherein: said function of time Z(t) rises sharply to a maximum value upon depression of a key and gradually and monotonically decays off with the lapse of time.

9. A method of synthesizing a musical tone signal according to claim 1, wherein: said function of time Z(t)

rises to a predetermined value upon depression of a key, and sustains said predetermined value thereafter.

10. A method of synthesizing a musical tone signal according to claim 3, wherein: one of the ratio of frequencies $\omega_1'/\omega$ is selected to be a half integer and another of the ratio of frequencies $\omega_2'/\omega$ is selected at a value displaced from a half integer.

11. An electronic musical instrument including apparatus for synthesizing a non frequency modulated musical tone signal comprising:

first means for producing a first signal representing basic frequency information $\omega$ corresponding to the frequency of a tone to be sounded;

second means for directly receiving said first signal and producing a second signal representing a basic periodic function $F(\omega t)$ having $\omega t$ as the independent variable wherein t represents time;

third means for producing a third signal representing modulating frequency information $\omega$ having a preselected relationship to $\omega$;

fourth means for receiving said third signal and producing a fourth signal representing a first sinusoidal function $\sin(\omega' t)$ having $\omega' t$ as the independent variable;

fifth means for producing a fifth signal as a function of time $Z(t)$ representing a moduation index;

sixth means for receiving said fourth and fifth signals and delivering a sixth signal reprsenting a first multiplication product $Z(t) \sin(\omega' t)$ of said function of time and said first sinusoidal function;

seventh means for directly receiving said sixth signal and producing a seventh signal representing a second sinusoidal function $\cos[Z(t) \sin(\omega' t)]$ having said first product as the independent variable; and eighth means receiving said second and seventh signals for modulating said basic function in only an amplitude sense to directly produce said non frequency modulated musical tone signal output, said eighth means including means for multiplying said second and seventh signals to form a second multiplication product $F(\omega t) \cos[Z(t) \sin(\omega' t)]$.

12. An electronic musical instrument accirding to claim 11, further comprising:

ninth means producing an envelope function $A(t)$ having t as the independent variable wherein t represents time; and tenth means connected to said ninth means and said eighth means and delivering a third multiplication product $A(t) \cdot F(\omega t) \cdot \cos[Z(t) \cdot \sin(\omega' t)]$ of said envelope function and said second multiplication product as an envelope-imparted tone signal output.

13. An electronic musical instrument according to claim 12, wherein:

said third means produces a plurality of modulating frequency informations $\omega_i'$ wherein $i$ represents integers to distinguish from each other and lying between one and M which represents an integer larger than one, said eighth modulating means thereby delivers a plurality of said second products for the respective modulating frequency informations, said ninth means produces a plurality of envelope functions $A_i(t)$, said tenth means delivers a plurality of said third products for the respective distinguishing integers $i$; and said instrument further comprises: eleventh means to sum up said plurality of third products.

14. An electronic musical instrument according to claim 12, wherein:

said third means produces a plurality of modulating frequency informations $\omega_i'$ wherein $i$ represents integers to distinguish from each other and lying between one and M which represents an integer larger than one, said eighth means thereby delivering a plurality of said second products for the respective modulating frequency informations;

said tenth means produces a plurality of envelope functions $A_i(t)$, said tenth means delivers a plurality of said third products for the respective distinguishing integers $i$; and said instrument further comprises: eleventh means to multiply said plurality of third products with each other.

15. An instrument as in claim 11, wherein said third means produces said modulating frequency information at half an integer of the said basic frequency information.

16. An instrument as in claim 11, wherein said third means produces said modulating frequency information at a value displaced from half an integer of the said basic frequency information.

17. An instrument as in claim 11, wherein said third means produces said modulating frqeuency information as an irrational number relative to the said basic frequency information.

18. An instrument as in claim 11, having a plurality of keys and wherein said fifth means causes said fifth signal to rise sharply to a maximum value upon depression of a said key and gradually and monotonically to decay off with the lapse of time.

19. An instrument as in claim 11, having a plurality of keys and wherein said fifth means causes said fifth signal to rise to a predetermined value upon depression of a said key and to sustain said predetermined value thereafter.

20. An instrument as in claim 13, wherein said third means produces one of said modulating frequency informations at a half integer of the said basic frequency information and another one of said modulating frequency informations at a value displaced from a half integer of the said basic frequency information.

21. Apparatus for synthesizing a non frequency modulated musical tone signal containing a pluraliy of frequency components utilizing the formula $$N(t) = F(\omega t) \cos[Z(t) \sin(\omega' t)],$$

wherein $\omega$ and $\omega'$ represent angular frequencies having a preselected ratio, t represents time and Z represents a modulation index, comprising:

means for developing a basic function signal $F(\omega t)$, means for developing a modulating function signal $\cos[Z(t) \sin(\omega' t)]$, and means for modulating said basic function signal $F(\omega t)$ in only an amplitude sense to directly produce said non frequency modulated musical tone signal, said modulating means being multiplying means for multiplying said basic function signal $F(\omega t)$ by said modulating signal $\cos[Z(t) \sin(\omega' t)]$ to produce a multiplication product signal $F(\omega t) \cos[Z(t) \sin(\omega' t)]$ said non frequency modulated musical tone signal $N(t)$.

22. Apparatus as in claim 21, wherein said multiplying means includes a digital multiplier.

23. Apparatus as in claim 21, wherein said multiplying means includes a variable gain amplifier.

24. Apparatus as in claim 21, and further including:

means for developing an envelope function signal A(t), and second means for multiplying said product signal by said envelope function to produce an envelope-imparted musical tone signal.

25. Apparatus as in claim 24, including:

a signal-to-audio transducing device converted directly to said second multiplying means for changing said envelope-imparted musical tone signal directly into a musical tone.

26. Apparatus as in claim 24, wherein said second multiplying means produces digital product signals, and further including:

a signal-to-audio transducing device, and digital-to-analog converter means connecting said second multiplying means directly to said transducing device for changing said digital envelope-imparted musical tone signal directly into a musical tone at said transducing device.

27. Apparatus as in claim 21, including means for producing said ratio of $\omega':\omega$ as one of the following: half an integer, integer, displaced from half an integer, irrational number.

28. Apparatus as in claim 21, wherein said modulating function signal developing means includes means for producing a modulating index signal Z(t) having a value in the range of from $\pi/8$ to $8\pi$.

29. Apparatus as in claim 21, wherein said modulating function signal developing means includes means for producing a modulating index signal Z(t) which initially rises to a maximum value and gradually and monotonically decays with the lapse of time.

30. Apparatus as in claim 21, wherein said modulating function signal developing means includes means for producing a modulating index signal Z(t) which rises to a predetermined value which is sustained for a predetermined time.

31. Apparatus for synthesizing a non frequency modulated musical tone signal represented by N(t) and containing a plurality of frequency components utilizing the formula $N_i(t)=A_i(t)F(\omega t)\cos[Z(t)\sin(\omega_i't)]$, wherein $\omega$ and $\omega_i'$ represent angular frequencies having a preselected ratio, t represents time and Z represents a modulation index, comprising:

means for developing a basic function signal $F(\omega t)$, means for developing M iterations i of a modulating function signal $\cos[Z(t)\sin(\omega_i't)]$, M being an integer larger than one, values for $\omega_i'$ being different for a plurality of said iterations, means for iteratively modulating said basic function $F(\omega t)$ in only an amplitude sense to produce M non frequency modulated tone signals, said iteratively modulating means being multiplying means for multiplying said basic function signal $F(\omega t)$ successively by said M iterations of the modulating function signal to produce said M tone signals, means for producing M envelope function signals $A_i(t)$, second multiplying means for multiplying said M tone signals by said M envelope function signals $A_i(t)$ respectively to produce M envelope-imparted non frequency modulated tone signals, and means for combining said M envelope-imparted tone signals to produce said N(t) non frequency modulated musical tone signal represented by the formula $A(t)F(\omega t)\cos[Z(t)\sin\omega't)]$.

32. Apparatus as in claim 31, wherein said combining means includes summing means for integrating said M envelope-imparted tone signals to produce said musical tone signal N(t).

33. Apparatus as in claim 31 wherein said combining means includes third multiplying means for multiplying said M envelope-imparted tone signals to produce said musical tone signal N(t).

34. Apparatus as in claim 31, including:

a signal-to-audio transducing device connected directly to said combining means to convert said musical tone signal N(t) directly into a musical tone.

35. Apparatus as in claim 31, wherein the said M iteration developing means includes means for producing said ratio of $\omega_i':\omega$ as one of the following: half an integer, integer displaced, displaced from half an integer, irrational number.

36. Apparatus as in claim 31, wherein the said M iteration developing means includes means for producing a modulating index signal Z(t) having a value $\pi/8 \leqq Z(t) \leqq 8\pi$.

37. Apparatus as in claim 31, wherein the said M iteration developing means includes means for producing a modulating index signal Z(t) which initially rises to a maximum value and gradually and monotonically decays with the lapse of time.

38. Apparatus as in claim 31, wherein the said M iteration developing means includes means for producing a modulating index signal Z(t) which rises to a predetermined value which is sustained for a predetermined time.

39. Apparatus for synthesizing a musical tone signal N(t) which is a combination of $N(t_1)$ and $N(t_2)$ wherein $N(t_1)=F(\omega t)\cos[Z_1(t)\sin(\omega_1 t)]$ and $N(t_2)=F(\omega t)\cos[Z_2(t)\sin(\omega_2 t)]$ wherein $\omega$, $\omega_1$ and $\omega_2$ represent angular frequencies, t represents time and $Z_1$ and $Z_2$ represent modulation indicies, comprising:

means for developing a basic function signal $F(\omega t)$, means for developing a first modulating function signal $\cos[Z_1(t)\sin(\omega_1 t)]$, means for developing a second modulating function signal $\cos[Z_2(t)\sin(\omega_2 t)]$, means for modulating said basic function signal $F(\omega t)$ in only an amplitude sense to directly produce first and second non frequency modulated tone signals $N_1(t)$ and $N_2(t)$, said modulating means being multiplying means for multiplying said basic function signal $F(\omega t)$ by said first modulating signal to produce a first multiplication produce signal $F(\omega t)\cos[Z_1(t)\sin(\omega_1 t)]$ as said first tone signal $N_1(t)$ and for multiplying said basic function signal $F(\omega t)$ by said second modulating signal to produce a second multiplication product signal $F(\omega t)\cos[Z_2(t)\sin(\omega_2 t)]$ as said second tone signal $N_2(t)$, and means for combining said $N_1(t)$ and $N_2(t)$ tone signals to produce said N(t) musical tone signal.

40. Apparatus as in claim 39, wherein said combining means includes means for summing said $N_1(t)$ and $N_2(t)$ tone signals to produce said musical tone signal N(t).

41. Apparatus as in claim 39, wherein said combining means includes second multiplying means for multiplying said $N_1(t)$ and $N_2(t)$ tone signals to produce said musical tone signal N(t).

42. Apparatus as in claim 39, and further including means for developing an envelope function signal A(t), and third multiplying means for multiplying said musical tone signal N(t) by said envelope function signal A(t) to produce an envelope-imparted musical tone signal N(t)A(t).

43. Apparatus as in claim 42, and further including:

a signal-to-audio transducing device connected to said third multiplying means for converting said envelope-imparted musical tone signal N(t)A(t) into a musical tone.

44. Apparatus as in claim 42, wherein said third multiplying means produces said envelope-imparted musical tone signal N(t)A(t) as a digital signal, and further including:

a signal-to-audio transducing device, and digital-to-analog converter means for converting said digital envelope-imparted musical to signal into a musical tone at said transducing device.

45. Apparatus as in claim 39, including:

means in each of said first and second modulating function signal developing means for producing respective ratios $\omega_1:\omega$ and $\omega_2:\omega$ respectively as one of the following: half an integer, integer, displaced from half an integer, irrational number and for producing respective modulating indices $Z_1(t)$ and $Z_2(t)$ with respective values in the range from 90 /8 to $8\pi$.

46. Apparatus as in claim 45, wherein at least one of the modulating indices $Z_1(t)$ and $Z_2(t)$ initially rises to a maximum value and gradually and monotonically decays with the lapse of time.

47. Apparatus as in claim 45, wherein at least one of the modulating indices $Z_1(t)$ and $Z_2(t)$ rises to a predetermined value which is sustained for a predetermined time.

* * * * *